US006185399B1

(12) United States Patent
Zhao et al.

(10) Patent No.: US 6,185,399 B1
(45) Date of Patent: Feb. 6, 2001

(54) MULTICOLOR IMAGE-ON-IMAGE FORMING MACHINE USING AIR BREAKDOWN CHARGE AND DEVELOPMENT (ABCD) PROCESS

(75) Inventors: Weizhong Zhao, Webster; Chu-heng Liu, Penfield, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/449,597

(22) Filed: Nov. 29, 1999

(51) Int. Cl.[7] ..... G03G 15/01
(52) U.S. Cl. ..... 399/223; 399/237
(58) Field of Search ..... 399/223, 233, 399/237, 53, 57

(56) References Cited

U.S. PATENT DOCUMENTS

| | | | | |
|---|---|---|---|---|
| 4,267,556 | | 5/1981 | Fotland et al. | 346/153.1 |
| 4,504,138 | | 3/1985 | Kuehnle et al. | 355/10 |
| 4,885,220 | | 12/1989 | Kuhman et al. | 430/31 |
| 5,387,760 | | 2/1995 | Miyazawa et al. | 118/661 |
| 5,436,706 | | 7/1995 | Landa et al. | 355/256 |
| 5,619,313 | | 4/1997 | Domoto et al. | 399/233 |
| 5,937,248 | * | 9/1999 | Liu et al. | 399/237 |
| 5,953,559 | * | 9/1999 | Obu | 399/233 X |
| 5,987,283 | * | 11/1999 | Zhao et al. | 399/237 |

* cited by examiner

*Primary Examiner*—Quana M. Grainger
(74) *Attorney, Agent, or Firm*—Tallam Nguti

(57) ABSTRACT

A multicolor image-on-image reproduction machine includes a main assembly, a controller, a movable image bearing member having a path of movement, and a plurality of air breakdown charge and development (ABCD) imaging units mounted along the path of movement for forming color separation toner images. Each (ABCD) imaging unit includes a photoreceptor having a photoconductive surface forming a toner image separation development nip with the movable image bearing member; a toner supply apparatus for applying a layer of toner onto the photoconductive surface; a charging device for uniformly charging the photoconductive surface through the layer of toner; and an exposure device connected to the controller for image-wise exposing of the photoconductive surface and the layer of toner to form therein image areas and background areas of a desired color separation image. The multicolor image-on-image reproduction machine then includes a bias source for biasing the image bearing member at the toner image separation development nip to a potential sufficient to cause air breakdown selective recharging of the background areas of the layer of toner, thereby enabling the image areas of the layer of toner to be separated and developed as a color separation toner image onto the movable image bearing member, and the background areas thereof to remain on the photoreceptor.

8 Claims, 2 Drawing Sheets

MULTICOLOR IMAGE-ON-IMAGE FORMING MACHINE USING AIR BREAKDOWN CHARGE AND DEVELOPMENT (ABCD) PROCESS

RELATED CASES

This application is related to U.S. application Ser. No. 09/449,590 entitled "MULTICOLOR IMAGE-ON-IMAGE FORMING MACHINE USING REVERSE CHARGE PRINTING (RCP) PROCESS" filed herewith on the same date.

BACKGROUND OF THE INVENTION

The present invention relates generally to electrostatic latent image development, and, more particularly, concerns a multicolor image-on-image reproduction machine using air breakdown charge and development (ABCD) process.

Generally, processes for electrostatographic copying and printing are initiated by selectively charging and/or discharging a charge receptive image bearing member in accordance with an original input document or an imaging signal, generating an electrostatic latent image on the image bearing member. This latent image is subsequently developed into a visible image by a process in which charged developing material is deposited onto the surface of the latent image bearing member, wherein charged particles in the developing material adhere to image areas of the latent image. The developing material typically comprises carrier granules having toner particles adhering triboelectrically thereto, wherein the toner particles are electrostatically attracted from the carrier granules to the latent image areas to create a powder toner image on the image bearing member.

Alternatively, the developing material may comprise a liquid developing material comprising a carrier liquid having pigmented marking particles (or so-called toner solids) charge director materials dissolved therein, wherein the liquid developing material is applied to the latent image bearing image bearing member with the marking particles being attracted to the image areas of the latent image to form a developed liquid image. Regardless of the type of developing material employed, the toner or marking particles of the developing material are uniformly charged and are electrostatically attracted to the latent image to form a visible developed image corresponding to the latent image on the image bearing member.

The developed image is subsequently transferred, either directly or indirectly, from the image bearing member to a copy substrate, such as paper or the like, to produce a "hard copy" output document. In a final step, the image bearing member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface (see, for example, U.S. Pat. No. 4,267,556 and 4,885,220, among numerous other patents and publications), as well as other electrostatic printing systems wherein a charge carrying medium is adapted to carry an electrostatic latent image. It will be understood that the instant invention applies to all various types of electrostatic printing systems and is not intended to be limited by the manner in which the image is formed on the image bearing member or the nature of the latent image bearing member itself.

As described hereinabove, the typical electrostatographic printing process includes a development step whereby developing material is physically transported into contact with the image bearing member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Image quality in electrostatographic printing applications may vary significantly due to numerous conditions affecting latent image formation as well as development, among various other factors. In particular, image development can be effected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby. Similarly, one problem affecting the control of image quality in ionographic devices involves a phenomenon known as "image blooming" resulting from the effect of previously deposited ions or charge on the path of subsequent ions directed to the charge retentive surface. This problem is particularly noticeable when printing characters and edges of solid areas, resulting in character defects, wherein blooming artifacts may include picture elements being displaced by 1–2 pixels in distance. Image blooming can also be caused by poor charge retention and/or charge migration in the electrostatic latent image on the latent image bearing member, a problem which is particularly prevalent in ionographic systems, wherein a focused beam ion source is utilized for image-wise charging of a dielectric latent image bearing member.

The present invention more particularly, concerns a multicolor image-on-image reproduction machine advantageously using air breakdown charge and development (ABCD) process, and the following disclosures may be relevant to some aspects of the present invention. U.S. Pat. No. 4,504,138 discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image. An apparatus for carrying out the method of the invention is also disclosed, which includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the charge bearing surface to form a latent image electrostatically, such that the charge-dissipated portions of the charge bearing surface have the first electrical potential of the charge bearing surface. The method also includes the steps of moving an member biased to a third electrical potential that lies between said first and said second potentials, into a nip forming relationship with the moving image bearing member to form a process nip. The method further includes the step of introducing charged liquid toner having a fourth electrical potential into the process nip, such that the liquid toner sandwiched within the nip simultaneously develops image portions of the latent image onto the member, and background portions of the latent image onto the charge bearing surface of the photoreceptor.

SUMMARY OF THE INVENTION

In accordance with one aspect of the present invention, there is provided a multicolor image-on-image reproduction machine that includes a main assembly, a controller, a movable image bearing member having a path of movement, and a plurality of air breakdown charge and development (ABCD) imaging units mounted along the path of movement for forming color separation toner images. Each (ABCD) imaging unit includes a photoreceptor having a photoconductive surface forming a toner image separation development nip with the movable image bearing member; a toner supply apparatus for applying a layer of toner onto the photoconductive surface; a charging device for uniformly charging the photoconductive surface through the layer of toner; and an exposure device connected to the controller for image-wise exposing of the photoconductive surface and the layer of toner to form therein image areas and background areas of a desired color separation image. The multicolor image-on-image reproduction machine then includes a bias source for biasing the image bearing member at the toner image separation development nip to a potential sufficient to cause air breakdown selective recharging of the background areas of the layer of toner, thereby enabling the image areas of the layer of toner to be separated and developed as a color separation toner image onto the movable image bearing member, and the background areas thereof to remain on the photoreceptor.

BRIEF DESCRIPTION OF THE DRAWINGS

For a general understanding of the features of the present invention, reference is made to the drawings, wherein like reference numerals have been used throughout to identify identical or similar elements.

DETAILED DESCRIPTION OF THE INVENTION

While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention as defined by the appended claims.

The present invention relates generally to electrostatic latent image development, and, more particularly, concerns a multicolor image-on-image reproduction machine using air breakdown charge and development (ABCD) process. An Air breakdown charge and Development (ABCD) process as disclosed for example in commonly assigned U.S. Pat. No. 5,937,243, issued Aug. 10, 1999 to Liu et al, involves the formation of a desired final toner image from a layer of marking material coated onto an image bearing member. This is achieved by selectively applying charges to the layer of marking material via air breakdown so as to create an image-wise charged marking material layer having image areas and background areas. The image-wise charged marking material layer is thus capable of being selectively separated image-wise, into background areas, and image areas comprising the desired final toner image.

Figure 1:
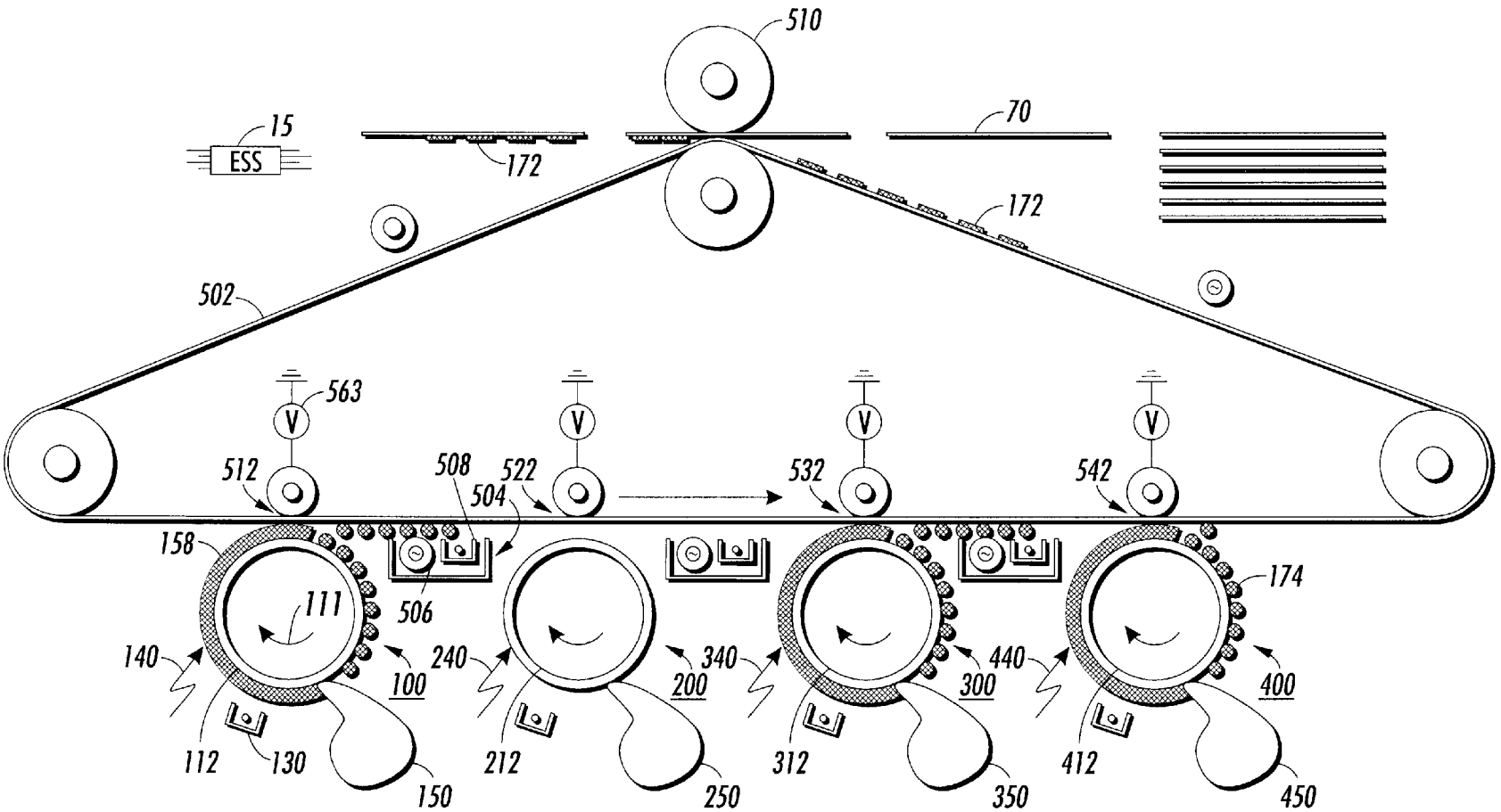
FIG. 1 is a schematic illustration of a tandem multicolor reproduction machine including a plurality of (ABCD) imaging units using the process of image-wise toner layer charging via air breakdown charge and development in accordance with the present invention.

Referring first to FIG. 1, there is illustrated a tandem multicolor reproduction machine shown generally as 500.

As shown, the tandem multicolor reproduction machine 500 includes a plurality of (ABCD) imaging units 100, 200, 300, 400 that each include respectively a photoreceptor member 112, 212, 312, 412, and that each employ a process of image-wise toner layer charging via an air breakdown charge and development process to form a color separation toner image on the photoreceptor. Each color separation toner image is then developed in registration onto a biased image bearing member 502, where it is conditioned by an image stabilizing and conditioning device 504 in accordance with the present invention Referring now to FIGS. 1 and 2, each (ABCD) imaging unit 100, 200, 300, 400 as shown comprises an assemblage of operatively associated image forming elements, including a photoreceptor 112, 212, 312, 412 situated in contact with a biased image bearing member 502 at an image separating and transfer nip 512, 522, 532, 542 formed therebetween. Photoreceptor 112, 212, 312, 412 includes an imaging surface of any type capable of having an electrostatic latent image formed thereon. Photoreceptor 112, 212, 312, 412 may include a typical photoconductor or other photoreceptive component of the type known to those of skill in the art in electrophotography, wherein a surface layer having photoconductive properties is supported on a conductive support substrate. Although the following description will describe by example a system and process in accordance with the present invention incorporating a photoconductive photoreceptor, it will be understood that the present invention contemplates the use of various alternative embodiments for photoreceptor 112, 212, 312, 412 as are well known in the art of electrostatographic printing, including, for example, but not limited to, non-photosensitive photoreceptors such as a dielectric charge retaining member of the type used in ionographic printing machines, or electroded substructures capable of generating charged latent images.

Photoreceptor 112, 212, 312, 412 is rotated, as indicated by arrow 111, so as to transport the surface thereof in a process direction for implementing a series of image forming steps in a manner similar to typical electrostatographic printing processes. Initially, the photconductive surface of photoreceptor 112, 212, 312, 412 through a coating station where a layer of charged or uncharged toner particles is deposited by a toner supply apparatus on the surface of the photoreceptor 112, 212, 312, 412. To that end, a toner supply apparatus or applicator 150, 250, 350, 450 is provided, as depicted in detail in FIG. 2, whereby a layer of charged or uncharged toner particles (and possibly some carrier mechanism such as a liquid solvent) is applied onto the surface of the photoreceptor 112, 212, 312, 412. The toner supply apparatus 150, 250, 350, 450 may include an applicator roller 156 (biased by a source 155) which is rotated in a direction as indicated by arrow 157 to apply a substantially and uniformly distributed layer of toner, or a so-called "toner cake", 158 onto the surface of the photoreceptor 112, 212, 312, 412. A shown, the toner supply and applicator apparatus 150, 250, 350, 450 also includes a housing 152 that is adapted to accommodate a supply of toner particles 154 and any additional carrier material, if necessary. As shown, the applicator roller 156 is rotated in a direction as indicated by arrow 157 to transport toner from housing 152 into contact with the surface of the photoreceptor thus producing the toner "cake" or toner layer 158.

The toner cake 158 described above can be created in various ways. For example, depending on the materials utilized in the printing process, as well as other process parameters such as process speed and the like, a layer of toner particles having sufficient thickness, preferably on the order of between 2 and 15 microns and more preferably between 3 and 8 microns, may be formed on the surface of the photoreceptor 112, 212, 312, 412 by merely providing adequate proximity and/or contact pressure between the applicator roller 156 and the photoreceptor 112, 212, 312, 412. Alternatively, electrical biasing may be employed to assist in actively moving the toner particles onto the surface of the photoreceptor 112, 212, 312, 412.

After the toner "cake" or layer 158 is formed on the surface of the photoreceptor 112, 212, 312, 412, it passes through a charging station, which as shown includes a corona generating device 130 or any other charging apparatus for applying a uniform layer of electrostatic charge to the toner cake or layer 158. The corona generating device 130 charges the toner cake or layer 158 to a relatively high and substantially uniform potential.

After the toner cake or layer 158 is brought to a substantially uniform charge potential, it is advanced to an image exposure station, including an exposure device identified generally by reference numeral 140, 240, 340, 440. At the exposure station, the exposure device 140, 240, 340, 440, uniformly exposes the charged toner cake or layer 158 to a laser based input and/or output source that is controlled by an electronic subsystem (ESS) controller 15. The ESS 15, for example, is the main multi-tasking processor for operating and controlling all of the other subsystems of the multicolor tandem machine 500, and the toner image forming operations of each imaging unit.

The image exposure device 140, 240, 340, 440 thus projects a light image corresponding to the color separation image onto the charged photoconductive surface through the toner cake or layer 158. The light image projected thus, selectively dissipates the charge thereon for recording a primary electrostatic latent image therein. The primary electrostatic latent image comprises image areas defined by a first charge voltage and non-image areas defined by a second charge voltage in image configuration corresponding to the color separation image informational areas. The image exposure device 140, 240, 340, 440 may comprise anyone of various optical image formation and projection components as are known in the art, and may include various well known light lens apparatus or digital scanning system for forming and projecting an image from an original input document onto the photoreceptor 112, 212, 312, 412.

After the toner "cake" or layer 158 is image-wise exposed as such, it is then moved to the image separating and transfer nip 512, 522, 532, 542. As noted above, the image separating and transfer nip 512, 522, 532, 542 is formed therebetween the photoreceptor 112, 212, 312, 412 and the biased image bearing member 502. At the image separating and development nip, the exposed cake or layer 158 is recharged in an image-wise manner by inducing ionization of the air in the vicinity of the toner layer 158. To that end, the biased image bearing member 502 is provided, situated adjacent the toner layer 158, for introducing free mobile ions in the vicinity of the primary latent image in order to facilitate the formation of an image-wise ion stream extending from the image bearing member 502 to the primary latent image on the surface of the photoreceptor 112, 212, 312, 412. The image-wise ion stream generates a secondary latent image in the toner layer 158 made up of oppositely charged toner particles in image configuration corresponding to the primary latent image on the photoreceptor 112, 212, 312, 412.

The process of generating a secondary latent image in the toner cake layer 158 is described in greater detail in U.S. Pat. No. 5,937,243 as cited above, and relevant portions of which are incorporated herein by reference. As described therein, the charged toner cake for example can be a uniformly distributed layer of negatively charged toner particles having the thickness of a single layer or multiple layers of toner particles. The toner cake resides on the surface of the photoreceptor is transported past a biased member. The primary function of the biased member is to provide free mobile ions in the vicinity of the photoreceptor having the toner layer and primary latent image thereon. As it is known, when two conductors are held near each other with a voltage applied between the two, electrical discharge will occur as the voltage is increased to a point of air breakdown. Thus, at a critical point, a discharge current is created in the air gap between the conductors. This point is commonly known as the Paschen threshold voltage. When the conductors are very close together (a few thousandths of an inch) discharge can take place without sparking, such that a discharge current will be caused to flow across a gap between the biased member and the toner cake or layer. This phenomenon thus is used to induce image-wise charging, and hence a secondary latent image in the toner cake or layer 158.

As shown, the image bearing member 502 is biased at the nip 512, 522, 532, 542 by an electrical biasing source 563 capable of providing an appropriate voltage potential to the biased image bearing member 502, sufficient to produce image-wise air breakdown in the vicinity of a latent image bearing surface of the toner cake or layer 158. Preferably, the voltage applied to the biased image bearing member 502 is maintained at a predetermined potential such that electrical discharge is induced only in a limited region where the surface of the image bearing member 502 and the photoreceptor 112, 212, 312, 412 are in very close proximity and the voltage differential between the biased image bearing member 502 and the non-image areas of the primary latent image exceed the Paschen threshold voltage.

In one preferred embodiment, which will be known as "one-way breakdown", it is contemplated that the bias applied to the biased image bearing member 502 is sufficient to exceed the Paschen threshold voltage only with respect to either one of the image or non-image areas of the original latent image in the toner cake on the photoreceptor. Alternatively, in another embodiment, the bias applied to the biased image bearing member 502 will be sufficient to exceed the Paschen threshold with respect to both the image or non-image areas of the primary latent image. The air breakdown induced in this case can be caused to occur in a manner such that field lines are generated in opposite directions with respect to the image and non-image areas. For example, in the case where the Paschen threshold voltage is about 400 volts, and the image and non-image areas have voltage potentials of about 0 and 1200 volts respectively, a bias potential applied to the biased image bearing member 502 of approximately −200 volts will result in air breakdown that generates charges only in the region of the non-image areas such that the toner particles adjacent to this region will be affected. Conversely, a bias of −1000 volts applied to biased image bearing member 502, for example, will result in charge generation in the region of the image area of the latent image, with ions flowing in the opposite direction.

In yet another example, a bias of approximately −600 volts applied to the biased image bearing member 502 will result in charge generation in the areas adjacent to both image and non-image areas with ions flowing in opposite directions. This so-called 2-way air breakdown mode occurs where electrical discharge via air breakdown is induced in a pre-nip region immediately prior to a nip region created by contact between the photoreceptor 112, 212, 312, 412 and the image bearing member 502. The electrical discharge causes electrostatic fields to develop between the image bearing member 502 and the photoreceptor 112, 212, 312, 412 in the pre-nip region. In turn, the force of these fields causes the air to become ionized, generating free mobile ions which are directed toward the photoreceptor 112, 212, 312, 412. In a preferred embodiment, as illustrated in FIG. 1, a "one-way" ABCD is implemented such that only the background areas 74 are subjected to air breakdown and charge reversal.

After the secondary latent image is formed in the toner layer 158, the latent image bearing toner cake or layer 158 is moved completely through the image separating and transfer nip, 512, 522, 532, 542. Thus, referring back to FIG. 1, image separating and transfer nip, 512, 522, 532, 542 as mentioned above is formed by the photoreceptor 112, 212, 312, 412, and the biased image bearing member 502 having a surface adjacent to the surface of the photoreceptor 112, 212, 312, 412, and preferably contacting the toner layer 158 residing on photoreceptor 112, 212, 312, 412. The electrical biasing source 563 coupled to the biased image bearing member 502 also biases the image separating and transfer nip, 512, 522, 532, 542 so as to attract the image areas of the toner layer 158, thereby simultaneously separating and developing the toner layer 158 into image areas 172 (FIG. 2), and non-image areas 174. The polarity of the bias source 563 is such as to bias the image bearing member 502 (at the image separating and transfer nip, 512, 522, 532, 542) for attracting image areas 172 from the toner cake or layer 158. This results in image development by which image areas 172 of the toner cake 158 are separated and developed onto the surface of the biased image bearing member 502, while leaving background image areas 174 on the surface of the photoreceptor 112, 212, 312, 412.

Figure 2:
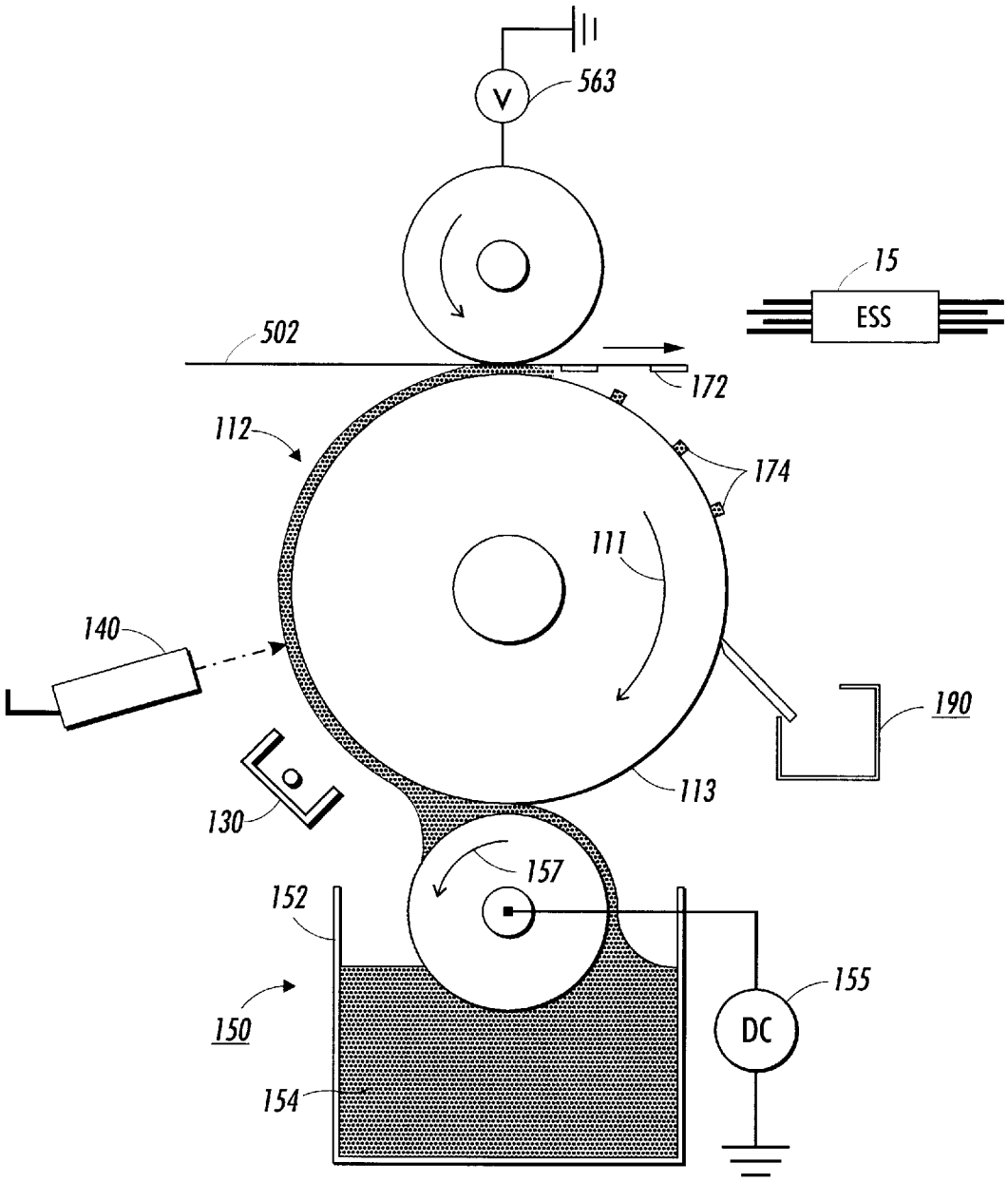
FIG. 2 is an enlarged schematic illustration of a typical (ABCD) imaging unit of FIG. 1 using the process of image-wise toner layer charging via air breakdown charge and development in accordance with the present invention.

In a final step on each imaging unit 100, 200, 300 400, the background areas 174 left on the photoreceptor after image transfer to the mage bearing member 502 is either recycled into the toner supply apparatus (FIG. 1) or removed from the surface thereof by a cleaning unit 190 (FIG. 2) in order to clean the surface in preparation for a subsequent imaging cycle. FIG. 2 illustrates a simple blade cleaning apparatus for scraping the photoreceptor surface as is well known in the art. Alternative embodiments may include a brush or roller member for removing toner from the surface on which it resides.

Referring in particular to FIG. 1, after the image areas 172 from each of the imaging units 100, 200, 300, 400, for example imaging unit 100, are developed as above onto the biased image bearing member 502 as a color separation toner image, it is conditioned and stabilized by an image stabilization device 504 as shown prior to the development and transfer of a the subsequent color separation toner image by the next imaging unit. As shown, image stabilization device 504 comprises a preferably heated pressure roller 506, and charging unit 508. The pressure roller 506 is made suitable for contacting the image areas or toner image 172 on the image bearing member 502 in order to increase toner layer strength by taking out carrier liquid from the toner image. Heat from the heated pressure roller 506 operates to increase toner layer strength by fusing or partially fusing the toner image on the image bearing member 502. The charging unit 508 for example is a corona device, and preferably has the same polarity as the polarity of the charge on the toner forming the image areas 172.

In accordance with the present invention, the charging device 130 for each imaging unit 100, 200, 300, 400 charges the layer of toner 158 to a polarity that is opposite that of the bias source 563 for biasing the image bearing member 502. On the other hand, charging unit 508 of the image stabilization device 504 charges the color separation toner image 172 to the same polarity as that of the charging device 130 of each the imaging units.

Such advantageous effects of heat can also be obtained without contact using a radiant heat source to increase toner layer strength by crosslinking polymer chains of toner particles forming the toner image on the image bearing member. In any case, the image stabilization device 504 thus conditions and stabilizes the color separation toner image so that minimum disturbances thereof will occur at the next image separation development nip. It also prevents color contamination at such next image separation development nip, as well as enhances the toner layer cohesiveness by increasing the solid concentration partially coalescing the toner particles. The image stabilization device 504 is additionally preferable in order to avoid any back transfer of the toner image already on the image bearing member 502 to the next photoreceptor, for example, due to wrong sign toner.

In accordance with the present invention, the value of the bias source 563 on the image bearing member 502 is preferably always outside the range of a bias on the photoreceptor of each imaging unit. In the machine 500, the bias source 563 at each image separating and transfer nip could be the same or equal for each imaging unit, and hence for each different color separation toner image being developed.

After each of the imaging units 100, 200, 300, 400 has formed and developed a color separation toner image to form a multicolor composite image on the surface of the biased image bearing member 502 as above, the multicolor composite image may then be transferred to a copy substrate 70. As shown such transfer may be via any means known in the art, which may include an electrostatic transfer apparatus including a corona generating device of the type previously described or a biased transfer roll. In a preferred embodiment, as shown in FIG. 1, the image is transferred to a copy substrate 70 via a heated pressure roll 510, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent.

In the present invention, the full or multicolor composite toner image is built up directly on a biased image bearing member 502 as opposed to a conventional intermediate transfer member. This advantageously enables easily holding the image electrostatically on the image bearing member 502, thus preventing degradation or smearing of the previous image in the next development nip.

As can be seen, there has been provided a multicolor image-on-image reproduction machine that includes a main assembly, a controller, a movable image bearing member having a path of movement, and a plurality of air breakdown charge and development (ABCD) imaging units mounted along the path of movement for forming color separation toner images. Each (ABCD) imaging unit includes a photoreceptor having a photoconductive surface forming a toner image separation development nip with the movable image bearing member; a toner supply apparatus for applying a layer of toner onto the photoconductive surface; a charging device for uniformly charging the photoconductive surface through the layer of toner; and an exposure device connected to the controller for image-wise exposing of the photoconductive surface and the layer of toner to form therein image areas and background areas of a desired color separation image. The multicolor image-on-image reproduction machine then includes a bias source for biasing the image bearing member at the toner image separation development nip to a potential sufficient to cause air breakdown selective recharging of the background areas of the layer of toner, thereby enabling the image areas of the layer of toner to be separated and developed as a color separation toner image onto the movable image bearing member, and the background areas thereof to remain on the photoreceptor.

It will be understood that the machine and processes described hereinabove represent only a few of the numerous system variants that could be implemented in the practice of the present invention.

We claim:

1. A multicolor image-on-image reproduction machine comprising:

(a) a main assembly including a controller and a movable image bearing member having a path of movement;

(b) a plurality of air breakdown charge and development (ABCD) imaging units mounted along said path of movement for forming color separation toner images, each (ABCD) imaging unit of said plurality thereof including:

(i) a photoreceptor including an photoconductive surface forming a toner image separation development nip with said movable image bearing member;

(ii) a toner supply apparatus for applying a layer of toner particles having a particular color onto said photoconductive surface of said photoreceptor;

(iii) a charging device for uniformly charging said photoreceptor; and (iv) an exposure device connected to said controller and mounted downstream of said first charging device for image-wise exposing said photoconductive surface and said layer of toner to form therein image areas and background areas of a desired color separation image; and (c) a bias source for biasing said image bearing member at said toner image separation development nip to a potential sufficient to cause air breakdown selective recharging of said background areas of said layer of toner, thereby enabling said image areas of said layer of toner to be separated and developed as a color separation toner image onto said movable image bearing member, and said background areas thereof to remain on said photoreceptor.

2. The multicolor image-on-image reproduction machine of claim 1, wherein said charging device is mounted downstream of said toner supply apparatus, relative to movement of said photoreceptor.

3. The multicolor image-on-image reproduction machine of claim 1, wherein said charging device charges said photoconductive surface through said layer of toner particles thereon.

4. The multicolor image-on-image reproduction machine of claim 1, including an image stabilization unit mounted downstream of each said image separation development nip, relative to movement of said image bearing member, and into contact with said color separation toner image, for increasing a toner layer strength of said color separation toner image prior to subsequent transfer onto said image bearing member of another color separation toner image.

5. The multicolor image-on-image reproduction machine of claim 1, wherein said charging device for each imaging unit charges said layer of toner to a polarity opposite that of said bias source for biasing said image bearing member.

6. The multicolor image-on-image reproduction machine of claim 4 wherein said image stabilization device includes a pressure roller and a charging unit.

7. The multicolor image-on-image reproduction machine of claim 6 wherein said pressure roller of said image stabilization unit is heated.

8. The multicolor image-on-image reproduction machine of claim 6 wherein said charging unit of said image stabilization device charges said color separation toner image to a same polarity as said charging device of each said imaging unit.

* * * * *